United States Patent [19]

Menichetti

[11] Patent Number: 4,645,088

[45] Date of Patent: Feb. 24, 1987

[54] PLASTIC CLOSURE FOR BOTTLES AND THE LIKE

[75] Inventor: Alberto Menichetti, Umiken, Switzerland

[73] Assignee: Gebrüder Hoffman AG, Thun, Switzerland

[21] Appl. No.: 774,974

[22] Filed: Sep. 11, 1985

[30] Foreign Application Priority Data

Oct. 5, 1984 [CH] Switzerland ..... 4788/84
Feb. 14, 1985 [CH] Switzerland ..... 663/85

[51] Int. Cl.[4] ..... B65D 41/04

[52] U.S. Cl. ..... 215/329; 215/344; 215/DIG. 1

[58] Field of Search ..... 215/344, DIG. 1, 329

[56] References Cited

U.S. PATENT DOCUMENTS

| | | | |
|---|---|---|---|
| 4,089,463 | 5/1978 | Babiol | 215/344 X |
| 4,269,320 | 5/1981 | Virog et al. | 215/344 X |
| 4,392,579 | 7/1983 | Uhlig et al. | 215/DIG. 1 |
| 4,416,383 | 11/1983 | Frahm et al. | 215/344 X |
| 4,429,802 | 2/1984 | Marks | 215/344 |

FOREIGN PATENT DOCUMENTS

| | | | |
|---|---|---|---|
| 667287 | 9/1964 | Italy | 215/DIG. 1 |
| 607702 | 10/1978 | Switzerland | 215/344 |
| 925647 | 5/1963 | United Kingdom | 215/344 |
| 960443 | 6/1964 | United Kingdom | 215/344 |

*Primary Examiner*—Donald F. Norton
*Attorney, Agent, or Firm*—Peter K. Kontler

[57] ABSTRACT

A one-piece plastic cap for the application to the externally threaded neck of a bottle has an end wall with a concave inner side which is provided with at least one elastic annular lip bearing against the end face of the neck when the internal thread or threads of the skirt of the cap mate with the external thread or threads of the neck. The configuration of the lip is such that the sealing action between its annular edge and the end face of the neck increases with increasing pressure in the interior of the bottle. The external surface of the end wall is formed with reinforcing ribs which radiate from the center of the end wall and can also extend along the exterior of the internally concave intermediate portion connecting the marginal portion of the end wall with the skirt. The ribs prevent pronounced expansion of the end wall and/or intermediate portion of the cap in response to establishment of a pronounced pressure differential between the interior and the exterior of the sealed bottle.

9 Claims, 2 Drawing Figures

PLASTIC CLOSURE FOR BOTTLES AND THE LIKE

BACKGROUND OF THE INVENTION

The present invention relates to closures in general, and more particularly to improvements in closures in the form of caps which are made of a synthetic plastic material and can be used as a means for sealing the necks of bottles or like containers. Still more particularly, the invention relates to improvements in internally threaded plastic caps which can mate with external threads on the necks of bottles and like containers.

It is well known to provide the end wall or bottom wall of a cup-shaped plastic cap with an internal seal which abuts against the end face of the neck when the cap is used to seal the open end of a bottle or the like. As a rule, the inner side of the bottom wall of the cap carries a disc of soft elastomeric material which is bonded to or is formed as an integral part of the cap. A drawback of such caps is that their making necessitates at least two discrete operations which contributes significantly to the manufacturing cost. Another drawback of conventional caps with disc-shaped sealing elements at the inner sides of their end walls is that such caps cannot undergo a sterilizing treatment and also that their material cannot be reused by recycling.

It was further proposed to make the cap from a single piece of synthetic plastic material and to reinforce the region between the end wall and the internally threaded tubular skirt of the cap by one or more circumferentially complete ribs having different dimensions. The ribs are adjacent to that end of the internal thread in the skirt which is nearest to the end wall and they are supposed to perform the function of sealing lips by coming into more or less pronounced engagement with the exterior of the neck forming part of a bottle which carries the cap. Reference may be had to British Pat. No. 960,443 which further shows a pronounced horizontal rib between the inner end of the internal thread and the inner side of the end wall of the cap. The manner of forming such pronounced ribs and especially of removing caps which embody such pronounced ribs from an injecting or other mass-producing machine is not disclosed in the patent.

Caps of the type disclosed in British Pat. No. 960,443 are intended for confinement of non-expandible goods and/or for confinement of commodities (such as beer) which are likely to be maintained at a pressure only slightly above the pressure of air in the surrounding atmosphere. However, the patented caps cannot be used on containers which confine goods requiring sterilization, pasteurization or a similar treatment.

British Pat. No. 925,647 discloses a method of making a modified closure or cap. The patented cap exhibits the drawback that its removal or expulsion from the making machine is a difficult and complex operation. The machine must be equipped with a specially designed injecting tool and the circumstances under which the cap is made must be monitored and regulated with a very high degree of precision. This, too, contributes to high initial cost of the patented cap.

British Pat. No. 925,647 already shows a cap which is formed with a curved bottom wall or end wall. The exterior of the transition zone between the end wall and the internally threaded skirt of the patented cap makes an obtuse angle and has a pronounced edge. Such edge is disposed radially outwardly of a thin flexible lip at the inner side of the cap. When the pressure in the interior of the container which carries the just discussed cap increases (e.g., in the course of a pasteurizing or sterilizing operation), stresses which develop in the region between the end wall and the skirt reach a value which is a multiple of the stresses in the end wall or in the skirt proper. Moreover, tension in the marginal portion of the end wall deviates very substantially from tension in the skirt. This results in radial expansion which is increased as a result of heating (e.g., for a period of up to 60 minutes within an autoclave which is used for sterilization or pasteurization of the contents of a bottle or another container carrying the patented cap) so that the cap is incapable of preventing communication between the interior and the exterior of the container. Moreover, the cap is likely to crack in the region of the open end of the skirt as a result of pronounced internal stresses and/or as a result of a pronounced pressure differential between the interior and the exterior of the container.

OBJECTS AND SUMMARY OF THE INVENTION

An object of the invention is to provide a simple and inexpensive plastic cap which can be used as a closure on bottles or the like, which can be mass-produced in simple machinery and in a single operation, and which can stand pronounced mechanically, thermally and/or otherwise induced tensional and other stresses.

Another object of the invention is to provide a cap wherein the connection between the end wall and the skirt is constructed and dimensioned in a novel and improved way.

A further object of the invention is to provide a cap which can stand pronounced deforming stresses arising as a result of pronounced differentials between the pressures in and outside of a sealed container as well as those stresses which arise as a result of exposure to elevated temperatures in an autoclave or the like in the course of a sterilizing, pasteurizing or like operation.

An additional object of the invention is to provide an extruded plastic cap which can be readily removed from an extruding or other mass-producing machine.

Still another object of the invention is to provide a plastic cap which can adequately seal the externally threaded neck of a bottle or a like container, even if the pressure in the interior of the container and/or in the region around the container fluctuates within a wide range.

An additional object of the invention is to provide a plastic cap which can adequately seal the externally threaded neck of a bottle or a like container, even if the temperature of the contents of the container and/or the temperature in the region around the container fluctuates within a wide range.

A further object of the invention is to provide a novel and improved method of making a plastic cap of the above outlined character.

The invention is embodied in a plastic cap for the application to bottles or other containers of the type including a portion having external threads and an open end bounded by an annular end face with a predetermined outer diameter. The improved cap comprises an end wall or bottom wall having a concave inner side and an elastic annular lip extending from the inner side into engagement with the end face of the portion of a container which carries the cap, an internally threaded tubular skirt which is arranged to surround the portion of the container whose end face is engaged by the lip, and an annular intermediate portion integrally connecting the end wall with the skirt. The radius of curvature of the concave inner side of the end wall equals or exceeds one-half the predetermined outer diameter, and the intermediate portion has a concave internal surface with a radius of curvature which is greater than one-tenth of the radius of curvature of the concave inner side of the end wall.

The end wall can have a substantially semielliptical or semispherical cross-sectional outline.

The cap can further comprise an array of reinforcing ribs which are provided on the external surface of the end wall and, if necessary on the external surface of the intermediate portion and skirt, and radiate from the center of the end wall.

The cap can also comprise a ring-shaped sealing element which extends from the inner side of the end wall, which surrounds the lip, and which has a contour conforming, at least substantially, to that of the portion of the container in the region of the end face of such portion. The ring-shaped element is made of an elastomeric material and is preferably provided with a circumferentially complete groove having an outer diameter which approximates and can be somewhat less than the predetermined outer diameter of the end face of the externally threaded portion of the container.

The lip has an annular edge which is normally remote from the inner side of the end wall and comes into sealing engagement with the end face of the externally threaded portion when the external thread or threads of such portion mate with the internal thread or threads of the skirt. The inner diameter of the undeformed lip increases in a direction from the annular edge toward the inner side of the end wall so that the diameter of the edge decreases in automatic response to axial deformation of the lip, namely in response to a reduction of the distance between the inner side of the end wall and the end face of the externally threaded portion of the container. As the pressure in the interior of the sealed container increases, the diameter of the annular edge of the lip tends to increase whereby the edge is urged into an even more pronounced sealing engagement with the end face of the externally threaded portion.

The novel features which are considered as characteristic of the invention are set forth in particular in the appended claims. The improved closure itself, however, both as to its construction and the mode of making and using the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
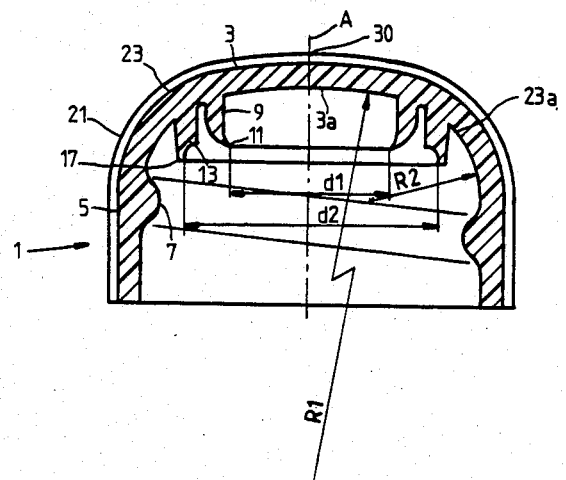
FIG. 1 is a central sectional view of a plastic closure or cap which embodies one form of the invention.

FIG. 1 shows a one-piece closure or cap 1 which is made of a synthetic plastic material and includes an end wall or bottom wall 3, a tubular wall or skirt 5, and an annular intermediate portion 23 which is integral with the end wall 3 as well as with the skirt 5. The skirt 5 is formed with an internal thread 7 which can have a single winding (see FIG. 1) or several windings (see FIG. 2).

The concave inner side 3*a* of the end wall 3 is formed with a ring-shaped elastic sealing lip 9 whose axis coincides with the axis A of the cap 1 and whose inner diameter $d_1$ decreases in a direction from the inner side 3*a* toward the annular sealing edge 11 of the lip.

The cap 1 further comprises a second ringshaped sealing element 13 which concentrically surrounds the lip 9 and extends from the inner side 3*a* in the region where the marginal part of the end wall 3 merges into the intermediate portion 23. The sealing element 13 has a substantially trapeziform cross-sectional outline and a contour which is complementary to that at the open end of the externally threaded portion or neck 19 of a bottle or an analogous container 29 which is to be sealed by the improved cap. The open end of the neck 19 is surrounded by a flat end face 33 whose plane is normal to the axis M when the cap is properly applied to the bottle. The neck 19 has external threads 25 which can mate with the internal thread or threads 9 of the skirt. The free end portion of the sealing element 13 has a circumferentially complete groove 37 surrounded by a relatively thin and flexible annular sealing tongue 17 which can engage the neck 19 around the end face 33 (see FIG. 2). The groove 37 is bounded by a concave surface of the sealing element 13. The maximum diameter $d_2$ of the groove 37 (i.e., the inner diameter of the sealing tongue 17) approximates but is somewhat less than the outer diameter of the neck 19 in the region of the end face 33.

The external surfaces of the end wall 3, intermediate portion 23 and skirt 5 are formed with reinforcing ribs 21 which radiate from the center 30 of the end wall 1, i.e., from the axis M. The ribs 21 may but need not extend beyond the end wall 3 and they may but need not extend along a portion of or the entire axial length of the skirt 5 (see FIG. 2 where the ribs terminate short of the open end of the cap 1').

At least the inner side 3*a* of the end wall 3 is concave (the thickness of the end wall 3 is preferably constant or nearly constant so that the external surface of the end wall 3 is convex) and the radius $R_1$ of curvature of the inner side 3*a* of the end wall 3 equals or exceeds half the diameter $d_3$ (i.e. half the maximum diameter of the end face 33 of the neck 19). The radius $R_2$ of curvature of the internal surface 23*a* of the intermediate portion 23 is a fraction of the radius $R_1$. For example, the ratio of the radii $R_1$ and $R_2$ can be between 2 to 1 and 10 to 1, preferably in the region of 4 to 1.

The thickness of the intermediate portion 23 and skirt 5 (save for the thread or threads 7) is preferably constant and matches or approximates the thickness of the end wall 3.

The provision of a concavo-convex end wall 3 and the aforementioned selection of radii of curvature of the inner side 3*a* of the end wall 3 and internal surface 23*a* of the intermediate portion 23 contribute significantly to a prevention of radial expansion of the cap during heating as well as to a reduction of tension in the material of the cap.

Figure 2:
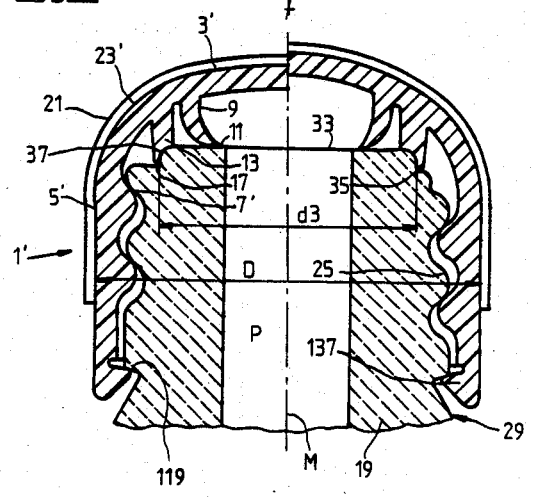
FIG. 2 is a similar central sectional view of a modified cap and of a portion of a container which is sealed by the cap, the left-hand half of FIG. 2 showing the form of the cap when the pressure in the container equals or slightly exceeds the pressure of air in the surrounding atmosphere and the right-hand portion of FIG. 2 showing the cap when the pressure in the interior of the container rises.

FIG. 2 shows a somewhat modified plastic closure or cap 1' which is applied to the externally threaded portion or neck 19 of a container in the form of a bottle 29 made of glass or a plastic material. The external thread or threads 25 of the neck 19 mate with the internal threads 7' of the skirt 5'. The left-hand portion of FIG. 2 shows the cap 1' in a condition it assumes when the pressure p in the interior of the bottle 29 matches or only slightly exceeds the pressure of air in the surrounding atmosphere. The right-hand portion of FIG. 2 shows the conditions which prevail when the pressure p in the interior of the bottle 29 appreciably exceeds the pressure of air in the region around the cap 1'. For example, the pressure p in the interior of the bottle 29 can rise as a result of rising temperature in the course of a sterilizing or analogous operation.

When the pressure differential between the interior and the exterior of the bottle 29 is low, the lip 9 of the end wall 3' of the cap 1' shown in FIG. 2 sealingly engages the end face 33 of the neck 19. The end face 33 is provided on the very tip 35 of the neck 19, i.e., on that part which extends axially beyond the external thread 25. The deforming force which develops in response to screwing of the internal threads 7' onto the external threads 25 causes the annular edge 11 of the lip 9 to slide along the end face 33 of the neck 19 and to move nearer to the axis M which is common to the bottle 29 and cap 1'.

If the pressure in the interior of the sealed bottle 29 begins to rise, the end wall 3' of the cap 1' acts not unlike the lid of a pressurized vessel. Were the end wall 3' flat, tension in its material could be calculated in accordance with the equation $TA=pD^2/4SA^2$ wherein p is the pressure in the bottle 29, D is the diameter of the end wall (i.e., the outer diameter of the skirt) and SA is the thickness of the end wall. Thus, the tension rises with the square of the diameter of the skirt and end wall.

An end wall 3' with a semispherical outline is more satisfactory. Thus, if the end wall 3' constitutes or resembles one-half of a hollow sphere, tension in the material of such end wall can be expressed with the equation $TB=pRS/2SB$ wherein RS equals D/2, i.e., the radius of the sphere, p is the pressure in the interior of the bottle 29 and SB is the wall thickness of the semispherical end wall. If one seeks a compromise between a spherical and a flat end wall, e.g., an end wall whose cross-sectional outline is that of one-half of an ellipse, the tension in the end wall will be somewhere between TA and TB. If the values of p and D ($RS=D/2$) remain unchanged, SA will equal the square root of DSB. A cap must have a flat end wall with a thickness of 5.3 mm in order to stand an internal pressure p which can be withstood by a semispherical end wall having a wall thickness of 1 mm. This presupposes that the cap is applied to a standard neck 19 with a diameter of 28 mm in accordance with the MC-A norm.

The effect of pressure upon the tension in the intermediate portion 23 or 23' of the cap 1 or 1' is also a function of the configuration of the end wall 3 or 3' and of the manner in which the marginal portion of the end wall merges into the intermediate portion 23 or 23'. The difference is quite pronounced between a cap wherein the end wall is flat and makes an angle of 90 degrees with the axis of a substantially cylindrical skirt, and a cap wherein the end wall is substantially semispherical with gradual transition into the skirt, i.e., wherein the internal surface of the intermediate portion has a relatively large radius of curvature.

Thus, if the end wall 3 or 3' is flat, the intermediate portion between the marginal portion of such flat end wall and the tubular skirt is subjected to very pronounced bending stresses which can exceed the resistance of the skirt to tearing. On the other hand, if the end wall has a substantially semispherical shape with gradual transition into the skirt, the bending stresses are practically non-existent and the cap merely undergoes a relatively small expansion in the radial direction. In order to counteract such radial expansion, the cross-section of the end wall of the cap preferably resembles one-half of an ellipse and the marginal portion of such end wall merges gradually and smoothly into the skirt.

The effect of elevated temperatures upon the sealing action of the cap depends on the nature of the material of the cap, particularly on the coefficient of expansion of such material. When the cap is made of any one of customarily employed materials for the making of plastic caps, the expansion coefficients for all such materials are substantially identical or do not deviate appreciably from each other. It is important to select a material whose expansion coefficient remains small and does not change appreciably in response to certain mechanical stresses (pressure) and thermal stresses while such stresses prevail. By appropriate selection of the configuration of the end wall and by appropriate selection of the material of the cap (such material should exhibit the aforediscussed small and constant expansion coefficient), one ensures that the improved cap retains its optimum sealing characteristics in the course of a pasteurizing and/or sterilizing treatment of the contents of the container which carries the cap.

If the pressure in the container rises in the course of a pasteurizing or sterilizing treatment, the end wall 3 or 3' rises above and away from the end face 33 of the neck 19 and the diameter of the shell 5 or 5' increases only by a minute fraction of one millimeter (e.g., by a few tenths of one millimeter). The expansion does not suffice to allow for a lifting of the elastic sealing lip 9 and/or the elastic annular sealing element 13 away from contact with the end face 33 of the neck 19. Moreover, the annular edge 11 of the lip 9 is urged radially outwardly in response to increasing pressure in the interior of the bottle 29 whereby the sealing action between the edge 11 and the end face 33 increases with increasing pressure differential between the interior and the exterior of the bottle.

If the lip 9 has a triangular cross-sectional outline with a small acute angle at the apex (in the region of the annular edge 11), its slender edge contacts the end face 33 practically without any transition.

The lip 9 and the sealing element 13 can be replaced with two or more annular lips which act upon the end face 33 and the end portion 35 of the neck 19. Such lips can be held in direct sealing engagement with the neck 19, or they can define a labyrinth seal.

If desired or necessary, the coupling between D the cap 1 or 1' and the neck 19 of the bottle 29 can include the thread or threads 7 or 7' as well as an inwardly extending annular collar 137 which is shown in FIG. 2 at the open end of the skirt 5' and engages a complementary external shoulder 119 of the neck 19. The collar 137 can constitute in integral part of the skirt 5' and is separated from the skirt preparatory to first opening of the bottle 29. The separated collar 137 remains on the neck or, if desired, it can be made of two or more arcuate sections which break away and become separated from the remainder of the cap as well as from the neck when the cap 1' is rotated in a direction to disengage the skirt 5' from the neck 19.

The cap 1 or 1' can be made by extrusion or in accordance with any other well known technique from a variety of suitable plastic materials in available plastic processing machines. The making of the cap is simple and can be completed in a single pass.

The reinforcing ribs 21 constitute an optional but desirable feature of the improved cap. Such ribs prevent excessive deformation of the end wall 3 or 3' in response to rising pressure in the interior of the container.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A plastic cap for containers of the type including an externally threaded portion and an open end bounded by an annular end face with a predetermined outer diameter, comprising an end wall having a concave inner side and an elastic annular sealing lip extending from said inner side into engagement with the end face of the externally threaded portion of a container which carries the cap; an internally threaded tubular skirt arranged to surround the externally threaded portion whose end face is engaged by said lip; an annular intermediate portion integral with said end wall and said skirt, said concave inner side having a radius of curvature which equals or exceeds one-half of said predetermined outer diameter and said intermediate portion having a concave internal surface with a radius of curvature which is greater than one-tenth of the radius of curvature of said inner side; and a ring-shaped sealing element extending from the inner side of said end wall, surrounding said lip and having a contour at least substantially conforming to that of the adjacent part of the externally threaded portion of the container carrying the cap, said sealing element having a circumferentially complete groove with an outer diameter approximating said predetermined outer diameter.

2. The cap of claim 1, wherein said end wall has a substantially semielliptical cross-sectional outline.

3. The cap of claim 1, wherein said end wall has a substantially semispherical cross-sectional outline.

4. The cap of claim 1, wherein said end wall has an external surface provided with an array of reinforcing ribs.

5. The cap of claim 4, wherein said reinforcing ribs radiate from the center of said end wall.

6. The cap of claim 4, wherein said intermediate portion has an external surface and at least some of said ribs extend along the external surface of said intermediate portion.

7. The cap of claim 6, wherein said skirt has an external surface and at least some of said ribs extend along the external surface of said skirt.

8. The cap of claim 1, wherein said sealing element is elastic and the outer diameter of its groove is less than said predetermined outer diameter.

9. The cap of claim 1, wherein said lip has an annular edge which bears against the end face of the externally threaded portion of the container which carries the cap, the inner diameter of said lip increasing in a direction from said edge toward the inner side of said end wall so that the diameter of said edge tends to decrease in response to movement of the inner side of the end wall nearer to the end face of the externally threaded portion of the container which carries the cap and the increasing pressure in the interior of the container tends to effect a radial expansion of said edge.

* * * * *